US006796451B2

(12) United States Patent
Harris

(10) Patent No.: US 6,796,451 B2
(45) Date of Patent: Sep. 28, 2004

(54) PRESSURE DEACTIVATED TORQUE OVERRIDE COOLANT CAP

(75) Inventor: Robert S. Harris, Connersville, IN (US)

(73) Assignee: Stant Manufacturing Inc., Connersville, IN (US)

( * ) Notice: Subject to any disclaimer, the term of this patent is extended or adjusted under 35 U.S.C. 154(b) by 0 days.

(21) Appl. No.: 10/198,243

(22) Filed: Jul. 18, 2002

(65) Prior Publication Data

US 2004/0011788 A1 Jan. 22, 2004

(51) Int. Cl.[7] ..... B65D 51/16

(52) U.S. Cl. ..... 220/203.26; 220/203.22; 220/DIG. 32

(58) Field of Search ..... 220/303, 330, 220/202, 203.22–203.29, 203.01, 203.1, 203.9, 203.06, DIG. 32, DIG. 33, DIG. 17, 304, 582, 86.2, 89.1, 746, 316, 251

(56) References Cited

U.S. PATENT DOCUMENTS

| | | | | | |
|---|---|---|---|---|---|
| 4,000,633 | A | | 1/1977 | Evans | |
| 4,083,209 | A | | 4/1978 | Sloan, Jr. | |
| 4,107,961 | A | * | 8/1978 | Evans | 70/165 |
| 4,136,795 | A | | 1/1979 | Crute et al. | |
| 4,146,147 | A | | 3/1979 | Sloan, Jr. | |
| 4,185,751 | A | | 1/1980 | Moore et al. | |
| 4,280,346 | A | | 7/1981 | Evans | |
| 4,280,347 | A | | 7/1981 | Evans | |
| 4,497,290 | A | | 2/1985 | Harris | |
| 4,497,419 | A | | 2/1985 | Reitzel | |
| 4,498,493 | A | | 2/1985 | Harris | |
| 4,676,390 | A | | 6/1987 | Harris | |
| 4,726,488 | A | * | 2/1988 | Kasugai | 220/203.25 |
| 4,765,505 | A | | 8/1988 | Harris | |
| 4,779,755 | A | | 10/1988 | Harris | |
| 4,830,058 | A | | 5/1989 | Harris | |
| 4,887,733 | A | | 12/1989 | Harris | |
| 5,108,001 | A | | 4/1992 | Harris | |
| 5,110,003 | A | | 5/1992 | MacWilliams | |
| 5,169,015 | A | | 12/1992 | Burke | |
| 5,449,086 | A | | 9/1995 | Harris | |
| 5,480,055 | A | | 1/1996 | Harris et al. | |
| 5,520,300 | A | | 5/1996 | Griffin | |
| 5,529,201 | A | | 6/1996 | Tallent et al. | |
| 5,638,975 | A | | 6/1997 | Harris | |
| 5,732,840 | A | | 3/1998 | Foltz | |
| 5,791,507 | A | | 8/1998 | Harris et al. | |
| 5,794,806 | A | | 8/1998 | Harris et al. | |
| 5,904,057 | A | | 5/1999 | Abney, III et al. | |
| 5,941,407 | A | * | 8/1999 | De'Longhi | 220/316 |
| 6,079,584 | A | | 6/2000 | Griffin | |
| 6,095,363 | A | | 8/2000 | Harris et al. | |
| RE36,959 | E | | 11/2000 | Griffin | |
| 6,179,148 | B1 | | 1/2001 | Harris | |
| 6,223,923 | B1 | * | 5/2001 | Fishman | 220/210 |
| 6,230,918 | B1 | | 5/2001 | Huynh et al. | |
| 6,276,312 | B1 | | 8/2001 | Summan et al. | |
| 6,286,704 | B1 | | 9/2001 | Harris | |
| 6,325,233 | B1 | | 12/2001 | Harris | |

* cited by examiner

*Primary Examiner*—Lien Ngo
(74) *Attorney, Agent, or Firm*—Barnes & Thornburg LLP

(57) ABSTRACT

A cap for use on the threaded filler neck of a coolant reservoir, such as an automobile radiator, comprising a cover and main body and including: a means for transmitting torque from the cover to the main body to screw the cap onto the filler neck. The cap but for preventing excess torque from being transmitted. The cap includes a second torque transmission means for unscrewing the cap, which does not limit the torque that can be transmitted. The cap also includes a means for preventing the cap from being unscrewed when the coolant is under pressure; a pressure relief means to prevent the coolant pressure from exceeding a predetermined level; and a vacuum relief means for preventing the coolant pressure from falling below a second predetermined level.

8 Claims, 3 Drawing Sheets

PRESSURE DEACTIVATED TORQUE OVERRIDE COOLANT CAP

BACKGROUND

The present disclosure relates to a coolant cap used on an automobile cooling system, in particular, to a threaded coolant cap that prevents excessive torque from being applied to the cap threads as the cap is screwed onto a threaded radiator filler neck. The disclosure may also prevent removal of the cap while the coolant is pressurized, prevent excessive coolant pressure from building up in the system, and prevent a vacuum from occurring in the system relative to the atmospheric pressure when the coolant approaches ambient temperature.

Applying excessive torque while screwing a coolant cap onto a radiator or system filler neck may damage the cap, seals, threads, or make removing the cap difficult. Removing the cap while the coolant is hot and under pressure could cause serious injury. Allowing excessive pressure to build up in the cooling system beyond that for which the cooling system is designed could result in equipment failure and also personal injury. If a pressure relief valve bleeds coolant or vapor from the system when it is heated and expands, subsequent cooling and contraction of the coolant may create a vacuum in the system. Such a vacuum can make removing the cap difficult and could damage components of the cooling system not designed to withstand a net external pressure. The present disclosure addresses these problems.

According to the present disclosure, a coolant cap is adapted to be coupled to a threaded filler neck of a coolant reservoir, the coolant cap including a cover, a main body, and a torque override. The main body includes threads for engagement with the threads of the filler neck. The torque override transmits torque applied to the cover to the main body, enables the threads of main body to engage the threads of the filler neck, and limits the maximum torque that can be transmitted from the cover to the main body.

In the disclosed embodiment, the torque override includes fingers descending from the top wall of the cover, teeth on the main body upper wall, and an override spring, where each of the teeth has a first and a second flank. The first flank engages the fingers when the cap is turned clockwise so as to screw the cap threads onto the filler neck threads while the fingers apply a downward axial force on the main body teeth. The first flank is raked at a high angle so as to be inefficient at transmitting torque to the threads. The override spring is disposed between the cover and main body, so as to engage the cover and main body towards each other so that the teeth and fingers engage except the pressure is present in the system.

The torque transmission permits torque to be transmitted from the cover to the main body to unscrew the main body from the filler neck. When the counterclockwise or unscrewing torque is applied, the second flank of the teeth engage the fingers transmitting the unscrewing torque to the threads. The second flank of the teeth are raked nearly perpendicularat a low angle, so no downward force is required to keep the teeth engaged while unscrewing the cap.

The override spring disposed between the cover and main body pushes the cover and main body towards each other so that the teeth and fingers are normally engaged.

The cap also includes a pressure lock that prevents torque from being transmitted from the cover to the main body that would unscrew the main body from the filler neck while the coolant in the radiator is pressurized. The force of the coolant pressure acts on a valve body which transmits the force to the cap cover, preventing the teeth and fingers of the torque transmission means from being engaged. The coolant pressure is opposed by the override spring to provide a threshhold disengagement pressure greater than zero.

The cap also includes a pressure relief that prevents coolant pressure from exceeding an predetermined upper level. When the coolant pressure is below the predetermined upper level, a pressure relief spring holds a pressure relief piston in a closed position. When the pressure exceeds the predetermined level, the force on the relief piston causes the relief spring to compress and permits fluid to leak past the relief piston.

The cap also includes a vacuum relief that prevents the coolant pressure from falling below a lower predetermined level. When the coolant pressure is above a lower predetermined level, a vacuum relief spring holds the a vacuum relief seal ring closed against a relief piston. When the coolant pressure falls below the lower predetermined level, the force on the relief piston compresses the vacuum relief spring, opening the seal between the relief piston and vacuum relief seal ring and preventing a vacuum from forming in the radiator.

Other features of the disclosure will become apparent to those skilled in the art upon consideration of the following description of preferred embodiments exemplifying the best mode of carrying out the invention as presently perceived.

BRIEF DESCRIPTION OF THE DRAWINGS

The detailed description refers to the accompanying figures.

DETAILED DESCRIPTION OF THE DRAWINGS

Figure 1:
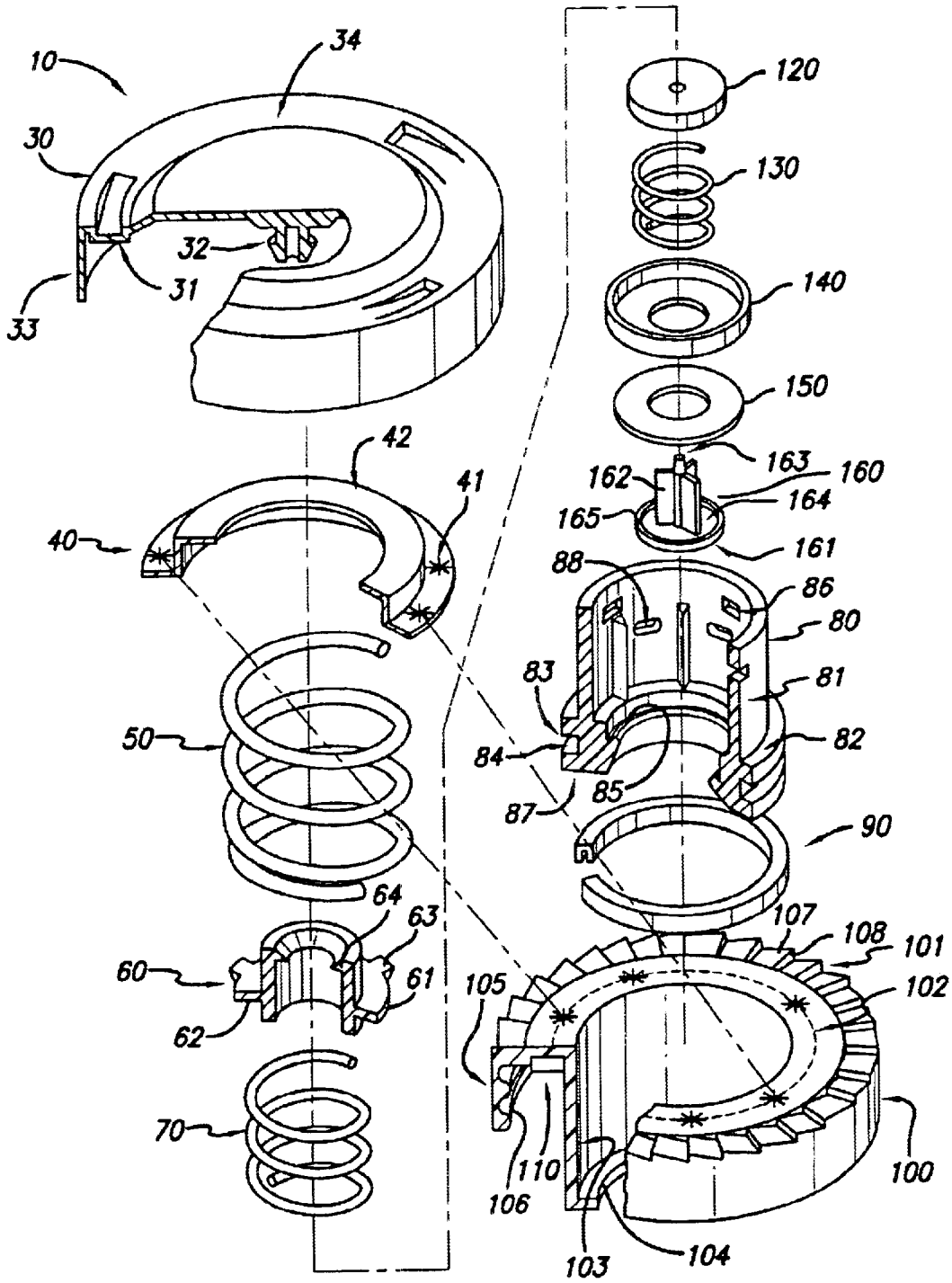
FIG. 1 is an exploded perspective view of components of the coolant cap made in accordance with the disclosure with some portions broken away to show their cross sectional shapes.

A coolant cap 10 is configured to close and seal on the open mouth of a threaded filler neck 12 of a radiator or coolant reservoir. FIG. 1 shows components of the coolant cap 10 comprising: an outer cover 30; override spring retainer 40; override spring 50; cap retainer 60; pressure release spring 70; valve components comprising upper vacuum piston 120, vacuum relief spring 130, pressure relief spring retainer 140, pressure relief seal 150, and lower vacuum relief piston 160; valve body 80; valve sealing ring 90; main body 100; and filler neck sealing ring 110.

Main body 100 has an outer wall 105 with internal threads 106 so that it can be screwed onto threaded filler neck 12. Seal ring 110 is situated in seal ring groove, such that seal ring 110 is compressed against the filler neck 12 to form a seal when main body 100 is screwed onto the filler neck 12.

Figure 2:
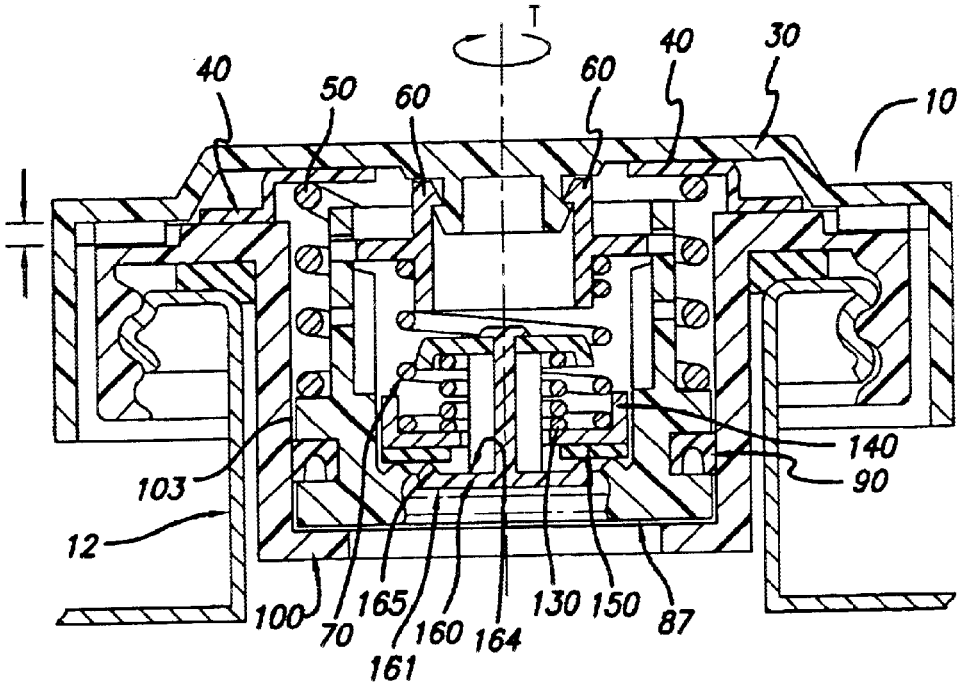
FIG. 2 is a sectional view of the coolant cap of FIG. 1 with no pressure in the radiator and the cap drive mechanism is engaged so the cap can be screwed onto or removed from the filler neck.

FIG. 2 illustrates the configuration of the cap as it is screwed onto the filler neck. To screw cap 10 onto filler neck 20, a torque T is applied to cap cover 30 about an axis of rotation 3. Cap cover 30 comprises a cylindrical side wall 33 and a top wall 34. One or more fingers or teeth 31 extend from the top wall to engage a series of teeth 101 on top wall 102 of the main body 100. The flanks 107, 108 of the teeth 101 are raked. The first tooth flank 107 engages the fingers 31 when the cap cover 30 is turned clockwise to tighten the coolant cap 1 onto the filler neck 3 (assuming right-hand threads are used). The first flank 107 is raked at a relatively large angle, typically greater than 60°. To apply torque T to main body 100 through cover 30 requires the user to turn the cover. Over-torque is prevented by flexure of the cantilever arms supporting the teeth.

When there is little or no pressure in the radiator, a counterclockwise torque causes the second flanks 108 of the teeth to engage the second flank of fingers 31. The low flank angles, typically near 0°, permit torque to be transmitted to the main body 100 more efficiently, i.e. with a no axial force.

Figure 3:
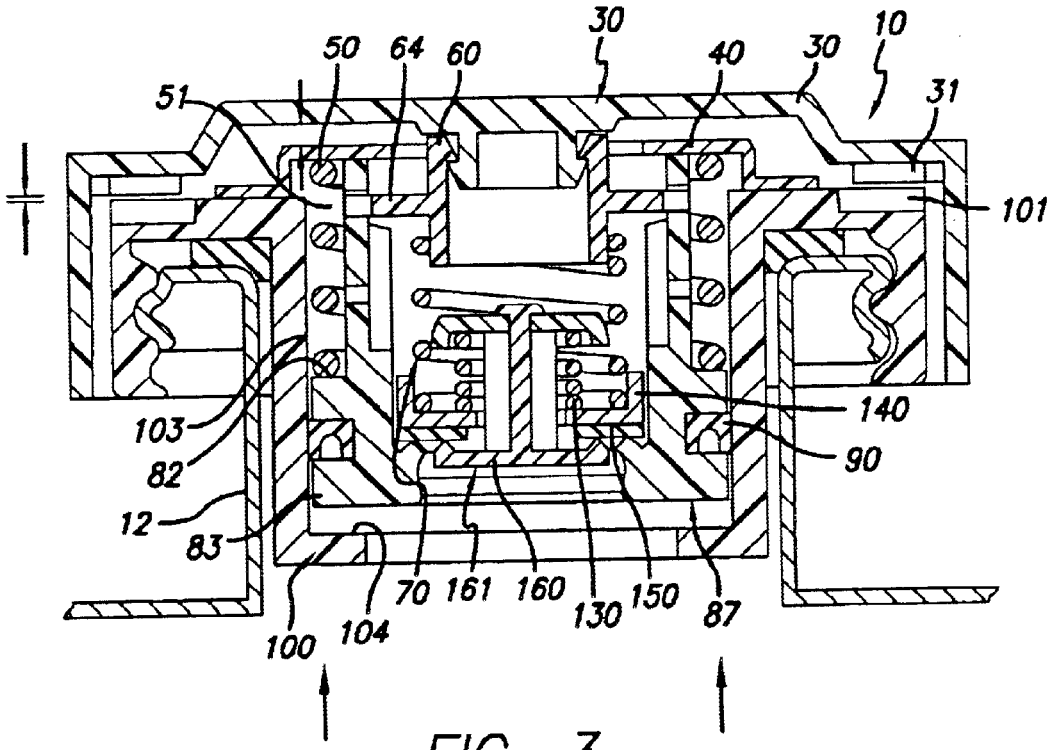
FIG. 3 is a sectional view of the coolant cap of FIG. 1, where the pressure in the radiator is sufficient to overcome the override spring and disengage the cap drive mechanism and prevent the cap from being removed.

FIG. 3 illustrates the configuration of the disclosure where the reservoir coolant pressure is high enough to compress override spring 50, which prevents teeth 101 and fingers 31 from being engaged and prevents the cap from being unscrewed. Override spring 50 is in an annular space 51 defined by spring retainer 40, inner wall 103 of the main body 100, outer wall 81 of valve body 80, and upper surface 82 of the valve flange 83. Flange 41 of spring retaining ring 40 is attached to upper surface 102 of main body 100 by welding or other means. Override spring 50 is preloaded, so that with no pressure in the radiator, it pushes up against spring retainer 40 and down on surface 82 of valve flange 83, which is pressed against lower flange 104 of main body 100. In turn, the cap retainer 60 through flange 64 engages plug 32 in cover 30 pulling it into contact with spring retainer 40 and loading the cantilever arms 31.

Tabs 63, extend from retainer flange 61 and are inserted into slots 86 in the valve body 80 to hold cap retainer 60 in place relative to valve body 80. The cap retainer 60 and valve body 80 are flexible enough to permit the cap retainer 60 to be forced into position. A male snap member 32 protrudes from the upper wall 34 of cap cover 30 and snaps into receiving slot 64 at the top of the cap retainer 60. This way, when assembled, cap cover 30, valve body 80, and cap retainer 60 are all connected and move together.

When the coolant is heated and pressurized, pressure on the lower surface 87 of valve body 80 forces valve body 80 upward, compressing drive spring 50, and moving cap cover 30 upward as well. This disengages fingers 31 and teeth 101. to unscrew the cap while the coolant is pressurized, the user would have to re-engage fingers 31 and teeth 101 by applying a downward axial force to cap cover 30 sufficient to overcome the upward force of the pressurized coolant on the valve body 80, pressure relief seal 150, and vacuum relief piston 160. Because such a force would be large, for even small coolant pressures, the cap 10 cannot be unscrewed while the coolant is pressurized.

Figure 4:
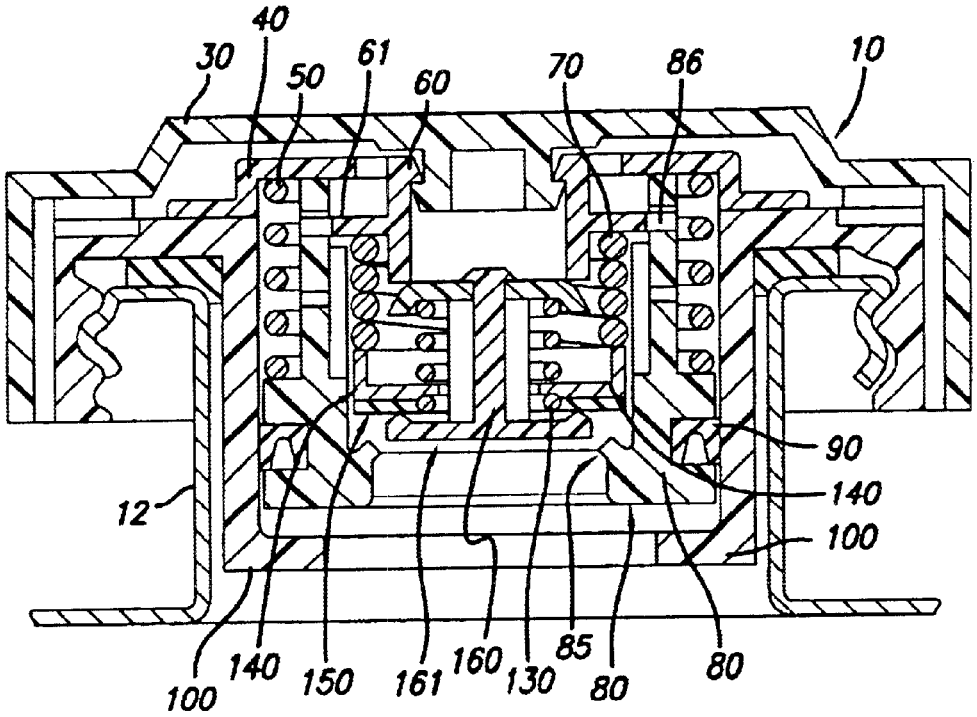
FIG. 4 is a sectional view of the coolant cap of FIG. 1, where the pressure in the radiator is sufficient to open the pressure relief mechanism.

FIG. 4 illustrates the configuration of the disclosure when the coolant pressure is high enough to activate the pressure relief feature. When the coolant reservoir pressure increases, an upward force on lower surface 161 of relief piston 160 is created. This upward force is transmitted through seal 150, relief spring retainer 140, relief spring 70 to cap retainer flange 61, and to valve body 80 through tabs 63 in slots 86. If the pressure force on the relief piston 160 and seal 150 is not sufficient to overcome the preload in spring 70, seal 150 remains in contact and seals against the lip 85 of valve body 80. If however, the pressure force is sufficient to compress spring 70, seal 150 and relief piston 160 move upward, and coolant is allowed to bleed past the valve body lip 85 and seal ring 150. The pathway from seal 150 to atmosphere is not sealed. When sufficient coolant has bled past the seal 150 and lip 85, the coolant pressure drops until it once again does not exceed the preload of spring 70, which pushes the relief spring retainer 140, seal 150, and relief piston 160 downward, re-establishing a seal between the seal ring 150 and valve body lip 85. The amount of coolant pressure necessary to open the seal between lip 85 and seal ring 150 can be predetermined by selecting appropriate dimensions of the lip 85 and the stiffness of spring 70.

Figure 5:
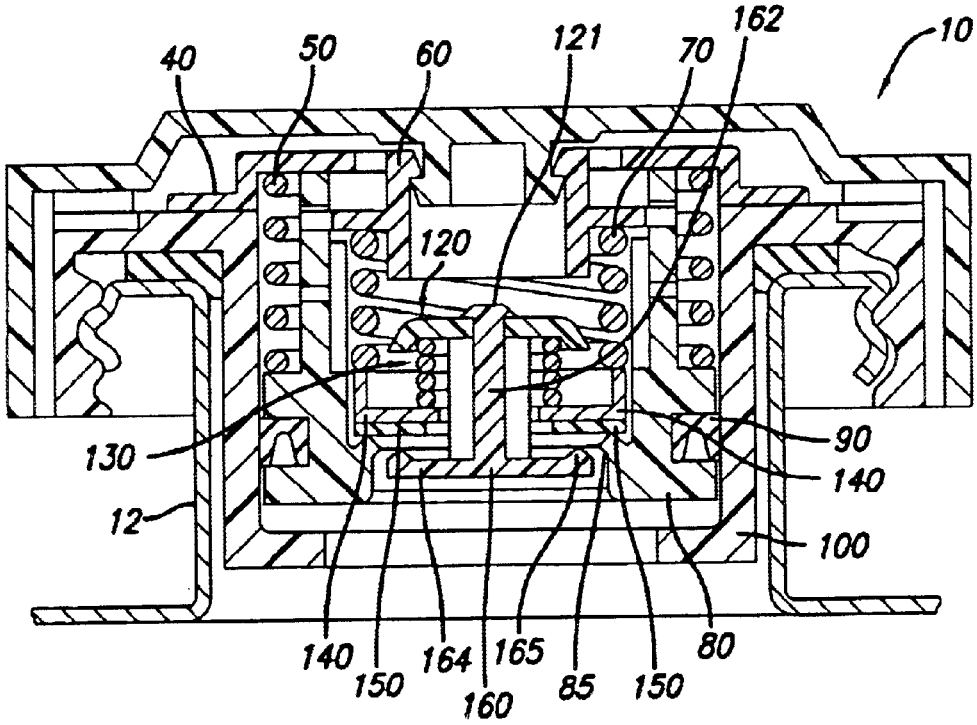
FIG. 5 is a sectional view of the coolant cap of FIG. 1, where the pressure in the radiator has dropped below the outside atmospheric pressure causing the vacuum relief mechanism to open.

FIG. 5 illustrates the configuration of the disclosure when the coolant pressure has fallen to a level sufficient to activate the vacuum relief feature. as radiator coolant cools, the coolant pressure in the radiator will drop and ultimately may become lower than atmospheric pressure, creating a net vacuum. This creates a downward force on the pressure relief valve 160, specifically on the upper surface 164 of piston 160. This downward force is transmitted through vacuum relief valve piston shaft 162 and to upper vacuum piston 120. The end of the vacuum relief valve piston shaft is passed through the upper vacuum piston hole 121 and swaged, so that it can exert the downward force on the upper vacuum piston. This compresses vacuum relief spring 130 against the vacuum relief spring retainer 140, which presses downward on seal ring 150, pressing it against lip 85. When the vacuum is sufficient to overcome the preload in spring 130, piston 160 moves downward as shown in FIG. 5, creating a gap between the relief piston lip 165 and the seal ring 150, which is held in place by the valve body lip 85. A pathway is thus created that allows coolant or air to bleed into the radiator. The amount of vacuum necessary to open the seal between surface 164 and seal ring 150 can be predetermined by selecting appropriate dimensions of the pressure relief valve piston 161 and the stiffness of spring 130.

The invention has been described in detail with reference to preferred embodiments. However, variations and modifications exist within the scope and spirit of the invention as described and defined in the following claims.

What is claimed is:

1. A cap apparatus adapted to be coupled to a threaded filler neck of a coolant reservoir, the cap comprising a cover;

a main body, the main body including threads for engagement with threads of a filler neck; and a means for transmitting torque applied to the cover to the main body enabling the threads of the main body to engage the threads of the filler neck, torque override means for limiting the maximum torque that can be transmitted from the cover to the main body;

means for preventing torque from being transmitted from the cover to the main body to unscrew the main body from the filler neck while the coolant reservoir is pressurized above a first predetermined pressure;

means for preventing the coolant pressure from exceeding an upper predetermined level; and means for preventing the coolant pressure from falling below a lower predetermined level.

2. A cap apparatus adapted to be coupled to a threaded filler neck of a coolant reservoir, the cap comprising a cover;

a main body, the main body including threads for engagement with threads of a filler neck; and means for transmitting torque applied to the cover to the main body that enables the threads of the main body to engage the threads of the filler neck, torque override means limiting the maximum torque that can be transmitted from the cover to the main body torque transmission means for permitting torque to be transmitted from the cover to the main body to unscrew the main body from a filler neck comprising fingers descending from the cover top wall, and a series of teeth on the main body upper wall wherein the teeth engage the fingers when an axial force is applied to the cover and where the flanks of the teeth engaged when the cap is unscrewed from filler neck are raked at a low angle;

an override spring disposed between the cover and main body that pulls the cover and main body away toward each other so that the teeth and fingers are only engaged when an axial force is applied to the cover pressure lock means for preventing torque from being transmitted from the cover to the main body to unscrew the main body from a filler neck while the coolant reservoir is pressurized comprising a valve body; a valve sealing ring, which forms a seal between the valve body and main body; a cap retainer attached to the valve body and to the cover; where the force of coolant pressure acting on the valve body is transmitted through the valve body and cap retainer to the cover, preventing the teeth and fingers from being engaged.

3. A cap apparatus adapted to be coupled to a threaded filler neck of a coolant reservoir, the cap comprising a cover having a first set of teeth;

a main body having a second set of teeth, the main body including threads for engagement with threads of a filler neck; and a first spring forcing the first set of teeth and second set of teeth into engagement whereby torque applied to the cover about an axis is transmitted to the main body enabling the threads of the main body to engage the threads of the filler neck, one of the first and second set of teeth being constructed to limit the maximum torque being transmitted from the first to the second set of teeth when the main body is being screwed onto the filler neck, a valve body coupled to the cap and movable with respect to the main body, a surface coupled to the valve body responsive to pressure in the reservoir above a first predetermined level to compress the first spring so that one of the first set of teeth and second set of teeth moves with respect to the other and torque applied to the cover about the axis to unscrew the main body from the filler neck is not transmitted to the main body, a relief piston movable with respect to the valve body and biased, via a second spring, to maintain pressure in the reservoir, wherein the second spring is responsive to pressure in the reservoir above a second predetermined level to release pressure in the reservoir to atmosphere, and a vacuum piston movable with respect to the valve body and biased, via a third spring, to maintain pressure in the reservoir, wherein the third spring is responsive to pressure in the reservoir below a third predetermined level to increase pressure in the reservoir from atmosphere.

4. The cap apparatus of claim 3 wherein the one of the first and second set of teeth are constructed of flexible material.

5. The cap apparatus of claim 4 wherein the one of the first and second set of teeth are raked at an angle.

6. The cap apparatus of claim 3 wherein the surface coupled to the valve body separates the first set of teeth and second set of teeth in response to pressure in the reservoir above a first predetermined level.

7. A cap apparatus adapted to be coupled to a threaded filler neck of a coolant reservoir, the cap comprising a cover having a first set of teeth, a main body having a second set of teeth, the main body including threads for engagement with threads of a filler neck, a spring forcing the first set of teeth and second set of teeth into engagement whereby torque applied to the cover about an axis to screw the main body onto the filler neck is transmitted to the main body enabling the threads of the main body to engage the threads of the filler neck, at least one of the first or second set of teeth being constructed at an angle and flexible to limit the amount of torque transmitted from the cover to the main body to screw the main body onto the filler neck, a valve body coupled to the cap and movable with respect to the main body, a surface coupled to the valve body responsive to pressure in the reservoir above a first predetermined level to compress the first spring so that one of the first set of teeth and second set of teeth moves with respect to the other and torque applied to the cover about the axis to unscrew the main body from the filler neck is not transmitted to the main body.

8. A cap apparatus adapted to be coupled to a threaded filler neck of a coolant reservoir, the cap comprising a cover having a first set of teeth, a main body having a second set of teeth, the main body including threads for engagement with threads of a filler neck, a first spring forcing the first set of teeth and second set of teeth into engagement whereby torque applied to the cover about an axis to screw the main body onto the filler neck is transmitted to the main body enabling the threads of the main body to engage the threads of the filler neck, at least one of the first or second set of teeth being constructed at an angle and flexible to limit the amount of torque transmitted from the cover to the main body to screw the main body onto the filler neck, a valve body coupled to the cap and movable with respect to the main body, and a surface coupled to the valve body responsive to pressure in the reservoir above a first predetermined level to separate the first set of teeth from the second set of teeth so that torque applied to the cover about the axis to unscrew the main body from the filler neck is not transmitted to the main body;

a relief piston movable with respect to the valve body and biased, via a second spring, to maintain pressure in the reservoir, wherein the second spring is responsive to pressure in the reservoir above a second predetermined level to release pressure in the reservoir to atmosphere, and a vacuum piston movable with respect to the valve body and biased, via a third spring, to maintain pressure in the reservoir, wherein the third spring is responsive to pressure in the reservoir below a third predetermined level to increase pressure in the reservoir from atmosphere.

* * * * *